US007025055B2

(12) United States Patent
Scudder et al.

(10) Patent No.: US 7,025,055 B2
(45) Date of Patent: Apr. 11, 2006

(54) TRAY FOR SELECTABLY HEATING OR COOLING THE CONTENTS

(75) Inventors: James A. Scudder, Poway, CA (US); David C. Boucher, San Diego, CA (US); Peter J. Kapitzke, Poway, CA (US); Kenneth M. Sanderman, Lakeside, CA (US)

(73) Assignee: OnTech Delaware Inc., San Diego, CA (US)

( * ) Notice: Subject to any disclaimer, the term of this patent is extended or adjusted under 35 U.S.C. 154(b) by 56 days.

(21) Appl. No.: 10/800,802

(22) Filed: Mar. 15, 2004

(65) Prior Publication Data

US 2005/0198968 A1 Sep. 15, 2005

(51) Int. Cl.
*F24J 3/00* (2006.01)

(52) U.S. Cl. ..... 126/263.08; 126/263.09

(58) Field of Classification Search ..... 126/263.08, 126/263.09, 263.05; 62/4; 252/70
See application file for complete search history.

(56) References Cited

U.S. PATENT DOCUMENTS

| | | | | |
|---|---|---|---|---|
| 2,288,895 | A | 7/1942 | Fink | |
| 2,327,447 | A | 8/1943 | O'Brien | |
| 2,746,265 | A | 5/1956 | Mills | |
| 2,850,006 | A | 9/1958 | Karpalo | |
| 2,900,808 | A | 8/1959 | Wang | |
| 2,926,508 | A | 3/1960 | Moon | |
| 3,213,932 | A | 10/1965 | Gottfurcht | |
| 3,369,369 | A | 2/1968 | Weiss | |
| 3,815,867 | A | 6/1974 | Rein et al. | |
| 3,842,617 | A | 10/1974 | Chase et al. | |
| 3,863,832 | A | 2/1975 | Gordon et al. | |
| 3,871,357 | A * | 3/1975 | Grosso et al. | 126/263.09 |
| 3,874,557 | A | 4/1975 | Porter | |
| 3,970,068 | A | 7/1976 | Sato | |
| 4,090,898 | A | 5/1978 | Tuskos | |
| 4,501,259 | A | 2/1985 | Apellaniz | |

(Continued)

FOREIGN PATENT DOCUMENTS

| | | |
|---|---|---|
| CH | 356576 | 8/1961 |

(Continued)

OTHER PUBLICATIONS

Toppan, KK & Haros catalogue page; Annex 1, date unknown.

*Primary Examiner*—Alfred Basichas
(74) *Attorney, Agent, or Firm*—Cohen Sakaguchi & English LLP

(57) ABSTRACT

A tray for selectably heating or cooling the contents of the tray comprises a container body having a material chamber for containing said contents. The tray is specifically configured to heat of cool solid, semi-solid or viscous materials. The container body is generally flat wherein the width of the container body is greater than its height. The container body has a first compartment for housing a thermic module and a second compartment for containing the contents to be heated or cooled. Within the thermic module, an internal exothermic (or, alternatively, endothermic) chemical reaction is initiated to heat (or cool) the contents when a user actuates the thermic module. The thermic module comprises two reactant chambers separated by a breakable barrier, an actuator, and a piercing member movable between a retracted position and an extended position in response to a force placed on a portion of the actuator. A distal end of the piercing member breaks said breakable barrier when the piercing member is forced into the extended position to allow mixing of the reactants in the two reactant chambers.

19 Claims, 15 Drawing Sheets

U.S. PATENT DOCUMENTS

| | | | | | |
|---|---|---|---|---|---|
| 4,511,610 | A | | 4/1985 | Yazaki et al. | |
| 4,556,445 | A | | 12/1985 | McCormick | |
| 4,640,264 | A | | 2/1987 | Yamaguchi et al. | |
| 4,741,324 | A | | 5/1988 | Ina et al. | |
| 4,762,113 | A | | 8/1988 | Hamasaki | |
| 4,773,389 | A | | 9/1988 | Hamasaki | |
| 4,784,113 | A | | 11/1988 | Nagai et al. | |
| 4,784,678 | A | | 11/1988 | Rudick et al. | |
| 4,793,323 | A | | 12/1988 | Guida et al. | |
| 4,802,343 | A | | 2/1989 | Rudick et al. | |
| 4,816,048 | A | | 3/1989 | Kimmelshue | |
| 4,823,769 | A | * | 4/1989 | Semaan | 126/263.09 |
| 4,895,135 | A | | 1/1990 | Hamasaki | |
| 5,088,870 | A | | 2/1992 | Fukuhara et al. | |
| 5,169,524 | A | | 12/1992 | Meiritz et al. | |
| 5,255,812 | A | | 10/1993 | Hsu | |
| 5,295,475 | A | * | 3/1994 | Kaneko | 126/263.01 |
| 5,461,867 | A | | 10/1995 | Scudder | |
| 5,465,707 | A | | 11/1995 | Fulcher et al. | |
| 5,483,949 | A | | 1/1996 | James | |
| 5,542,418 | A | | 8/1996 | James | |
| 5,555,741 | A | | 9/1996 | Oakley | |
| 5,626,022 | A | | 5/1997 | Scudder et al. | |
| 5,699,952 | A | | 12/1997 | Fix, Jr. | |
| 5,809,786 | A | | 9/1998 | Scudder et al. | |
| 5,833,127 | A | | 11/1998 | Powell et al. | |
| 5,941,078 | A | | 8/1999 | Scudder et al. | |
| 5,979,164 | A | | 11/1999 | Scudder et al. | |

FOREIGN PATENT DOCUMENTS

| | | | |
|---|---|---|---|
| EP | 255494 | | 7/1987 |
| FR | 2659940 | | 9/1991 |
| GB | 2131542 | A | 12/1983 |
| JP | 62-078672 | | 5/1987 |
| JP | 1-085283 | | 6/1989 |
| JP | 1-085285 | | 6/1989 |
| JP | 1-088882 | | 6/1989 |
| JP | 1-161477 | | 11/1989 |
| JP | 2-048029 | | 4/1990 |
| JP | 2-098566 | | 4/1990 |
| JP | 2-126528 | | 10/1990 |
| JP | 2-130529 | | 10/1990 |
| JP | 3-218715 | | 9/1991 |
| JP | 4-025631 | | 2/1992 |
| JP | 4-025632 | | 2/1992 |
| JP | 4-117921 | | 4/1992 |
| JP | 4-164412 | | 6/1992 |
| JP | 4-108039 | | 9/1992 |
| JP | 4-279117 | | 10/1992 |
| WO | WO 93/17928 | | 9/1993 |

* cited by examiner

FIG. 18

| Mineral components | Concentration (mg/L) |
|---|---|
| Mineral components | 83.0 |
| Chloride | 11.7 |
| Fluoride | ND |
| Nitrate | ND |
| Silica | 28.0 |
| Sulfate | 3.4 |
| Calcium | 16.6 |
| Magnesium | 3.3 |
| Potassium | 1.3 |
| Sodium | 11.7 |
| Total Dissolved Solids | 130 |
| Hardness | 55.0 |
| Heavy Metals | ND |
| Arsenic | ND |
| Trihalomethanes | ND |
| pH | 7.04 |
| Conductivity ( S | 250 |

(ND = Not Detectable)

FIG. 19

Property

| Additive | Molecular Formula | Molecular weight | Physical State | Appearance | Odor | pH | Vapor Density |
|---|---|---|---|---|---|---|---|
| Sodium Benzoate | C7H5C2Na | 144.02 | Crystalline powder | white | Characteristic odor | ~8 | 4.97 |
| Fructose | C6(H2O)6 | 180.16g | white crystals | white | odorless | | |
| Sucrose | C12H22O11 | 342.3g | Momoclinic sphenoidal crystals | | Characteristic caramel | solutions are neutral to litmus | |
| Citric Acid | C6H8O7 | 192.12g | white granules | white | odorless | 2.2 (0.1N sol) | |

| Additive | Evaporation rate | MP | Solubility | Specific Gravity/ Density | Chemical Stability | Incompatibilities with Other Materials | Hazardous Decomposition Products |
|---|---|---|---|---|---|---|---|
| Sodium Benzoate | negligible | >300C | Soluble in water | 1.44 | Stable under normal temps and pressures | Strong oxidizing agents | CO, CO2, NaO |
| Fructose | | 103-105C | Soluble in water | | Stable under normal temps and pressures | Strong oxidizing agents | CO, CO2 |
| Sucrose | | 160-186C | 1gm/0.5ml water | 1.59 | Stable under normal temps and pressures | Oxidizers, suluric acid, and nitric acid | CO, CO2 |
| Citric Acid | | 153C | 60g/100ml at 20C | 1.665 | Stable under normal temps and pressures | Metal nitrates (explosive), alkali carbonates and bicarbonates, potassium tartrate. Will corrode copper, zinc, aluminum and their alloys | CO, CO2 |

TRAY FOR SELECTABLY HEATING OR COOLING THE CONTENTS

BACKGROUND OF THE INVENTION

1. Field of the Invention

The present invention relates generally to containers that include an internal module that adds heat to or removes heat from a material, such as a food, beverage, medicine, or the like, in the surrounding container.

2. Description of the Related Art

Containers may have integral modules for warming materials in the container, such as sake, coffee, or soup. Examples of such self-heating containers are disclosed in U.S. Pat. Nos. 5,461,867; 5,626,022; and 6,351,953 issued to Scudder et al. All patents, patent applications and other publications referenced in this application are hereby incorporated by reference herein in their entirety. Such containers typically include an outer can or body, in which the food or beverage is sealed, and an inner can or thermic module that contains two chemical reactants that are stable when separated from one another but, when they mix in response to actuation of the thermic module by a user, produce an exothermic reaction or, alternatively, an endothermic reaction and thereby heat or cool the contents of the container.

As part of the manufacturing process of such containers which are used for holding food and beverages, the containers must go through a sterilization process called "retort." In general the retort process consists of subjecting the container and food contents to high temperatures and pressures. In a typical retort process, the container and contents are placed in a chamber for several minutes at 252 degrees Fahrenheit and two bars of pressure. Accordingly, the containers must be designed to withstand the retort process and still function properly.

The heating or cooling module (thermic module) is typically attached at one end of the cylindrical container body, and the elongated cylindrical reaction chamber portion of the module extends into the container body. This elongated portion functions as both a chamber in which to contain the reaction and a heat-exchanger for transferring heat between it and the surrounding contents of the container body. The thermic module has two chambers, each of which contains one of the chemical reactants, separated by a breakable barrier such as metal foil or a thin plastic film. Typically, one of the reactants is a liquid, and the other is in a solid powdered or granular form. Calcium oxide (commonly known as limestone) and water are examples of two reactants known to produce an exothermic reaction to heat the contents in such containers. Other combinations of reactants are known to produce endothermic reactions to cool the container contents. A cap containing the liquid reactant is disposed in the end of the thermic module attached to the container body. At one end of the cap is an actuator button that a user may press to initiate the heating or cooling. The barrier seals the other end of the cap. The cap has a pushrod or similar prong-like member that extends from the actuator button nearly to the barrier. Depressing the actuator button forces the prong into the barrier, puncturing it and thereby allowing the liquid reactant to flow into the solid reactant in the reaction chamber. The heat produced by the resulting exothermic reaction or absorbed by the resulting endothermic reaction is transferred between the reaction chamber of the thermic module and the contents of the container body by conduction. Exothermic reactions also typically generate a gas and/or steam, which is allowed to escape through vents in the end of the container. The user inverts the container and, when the contents have reached the desired temperature, consumes the contents. The second end of the container body has a seal or closure, such as a conventional beverage can pull-tab, that may be opened and through which the user may consume the heated or cooled contents.

These elongated containers having elongated, cylindrical thermic modules and container bodies are best suited for heating or cooling liquid materials such as drinks, soups or other less viscous food products. The elongated containers are not as useful for solid, semi-solid or viscous food products, such as stew, chili, chicken, beef or the like. This is true for several reasons. First of all, the elongated container body is similar to a typical drinking container like a drinking glass or cup where the contents are consumed by drinking directly out of the container. The relatively small top surface of the elongated container body limits the size of the opening that can be provided for consuming out the contents of the container. This is fine for drinking or pouring directly out of the container, but when eating with a utensil such as a fork, spoon and/or knife, it is undesirable.

In addition, the heating of cooling of a liquid or low viscosity food product creates natural convection to distribute the heat from the heat source (cooling from the cold source, as the case may be) throughout the contents of the container. Moreover, minor movements or shaking of the container mixes the liquid further distributing the heat. With solid or more viscous contents, the heat from the heat source is non-uniformly applied to the food contents nearest the interface of the thermic module and the container body and heat is distributed mainly by conduction.

Accordingly, the present invention is directed to improvements in self-heating and self-cooling containers for solid, semi-solid or viscous food products which overcome these problems and deficiencies of previous containers.

SUMMARY OF THE INVENTION

The self-heating or self-cooling tray of the present invention is particularly configured for heating or cooling solid, semi-solid or less viscous materials. The following description of the invention will be directed to the self-heating version for heating food products with the understanding that the invention also encompasses self-cooling simply by replacing the exothermic reaction with an endothermic reaction and the food products may be replaced by any contents to be heated or cooled.

The self-heating tray comprises a container body which is in the shape of a tray or a bowl. The tray or bowl can by round, rectangular, oval or any other suitable bowl shape. The container body is relatively flat in dimension as opposed to being tall or elongated. In other words, the container body has a height and a width, wherein the width of the container body is greater than the height of the container body.

The container body has two compartments. A first compartment comprises the bottom portion of the container body and houses a thermic module disposed in the first compartment. The upper portion of the container body forms a second compartment. The second compartment holds the food product(s) to be heated. The second compartment may directly contain the food products, or the food products may be contained in a separate food container that is then placed into the second compartment. The separate food container may be held in the second compartment by a snap-fit, by an adhesive or any other suitable means.

The thermic module has two reactant chambers. The first reactant chamber contains a first reactant that is physically separated from a second reactant contained in the second reactant chamber. When a user actuates the thermic module, the reactants mix and produce a reaction that, depending upon the reactants, either produces heat, i.e., an exothermic reaction, and thereby heats the container contents, or absorbs heat, i.e., an endothermic reaction, and thereby cools the container contents.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein:

FIG. 18 is a table of mineral components in water that should not be exceeded.

FIG. 19 is a table of additives which may be added to the calcium oxide reactant.

DESCRIPTION OF PREFERRED EMBODIMENTS

Figure 6:
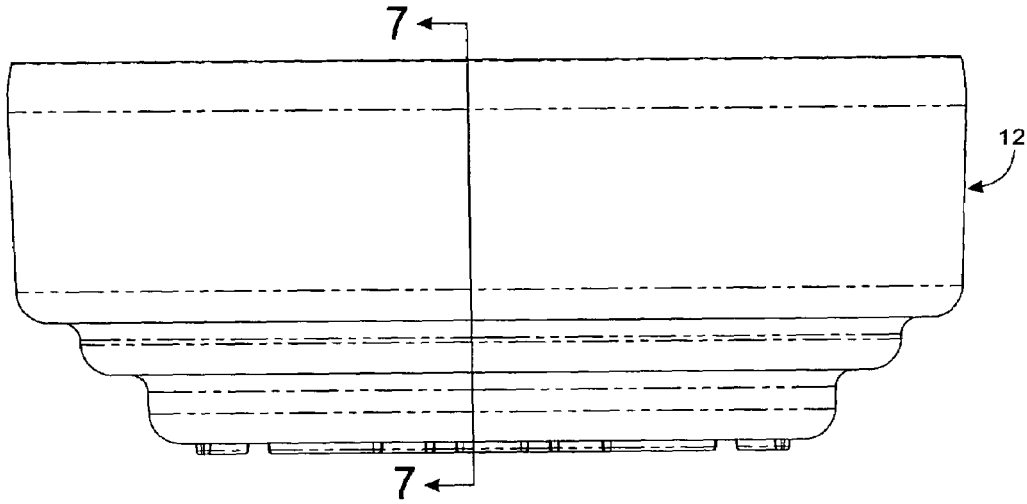
FIG. 6 is a side view of the container body of the self-heating tray of FIG. 1.
Figure 7:
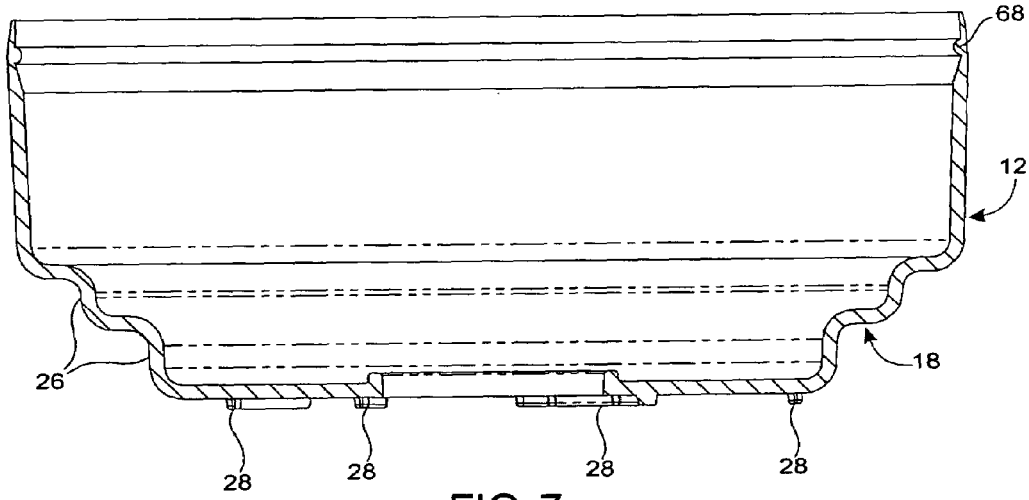
FIG. 7 is a cross-sectional view taken along line 7—7 of FIG. 6.

Turning to FIGS. 1–5, a self-heating (or self-cooling) tray assembly 10 includes a container body 12, a thermic module 14, and a food container 16. The container body 12 is shown separately from the assembly 10 in FIGS. 6 and 7. The container body 12 has a first compartment 18 comprising the bottom portion of the container body 12. The upper portion of the container body 12 forms a second compartment 20.

Figure 1:
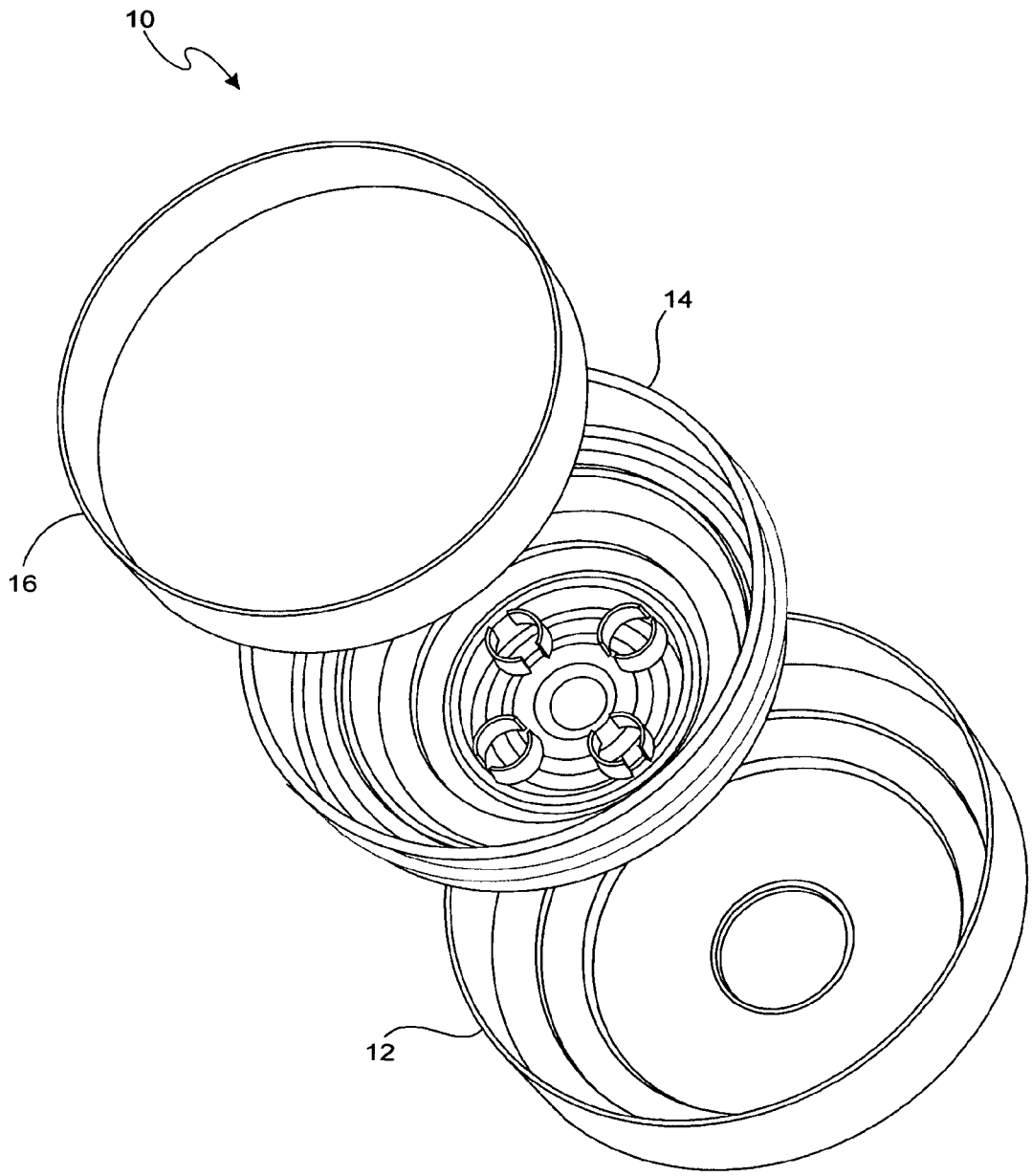
FIG. 1 is an exploded perspective top view of a self-heating tray assembly of the present invention.
Figure 2:
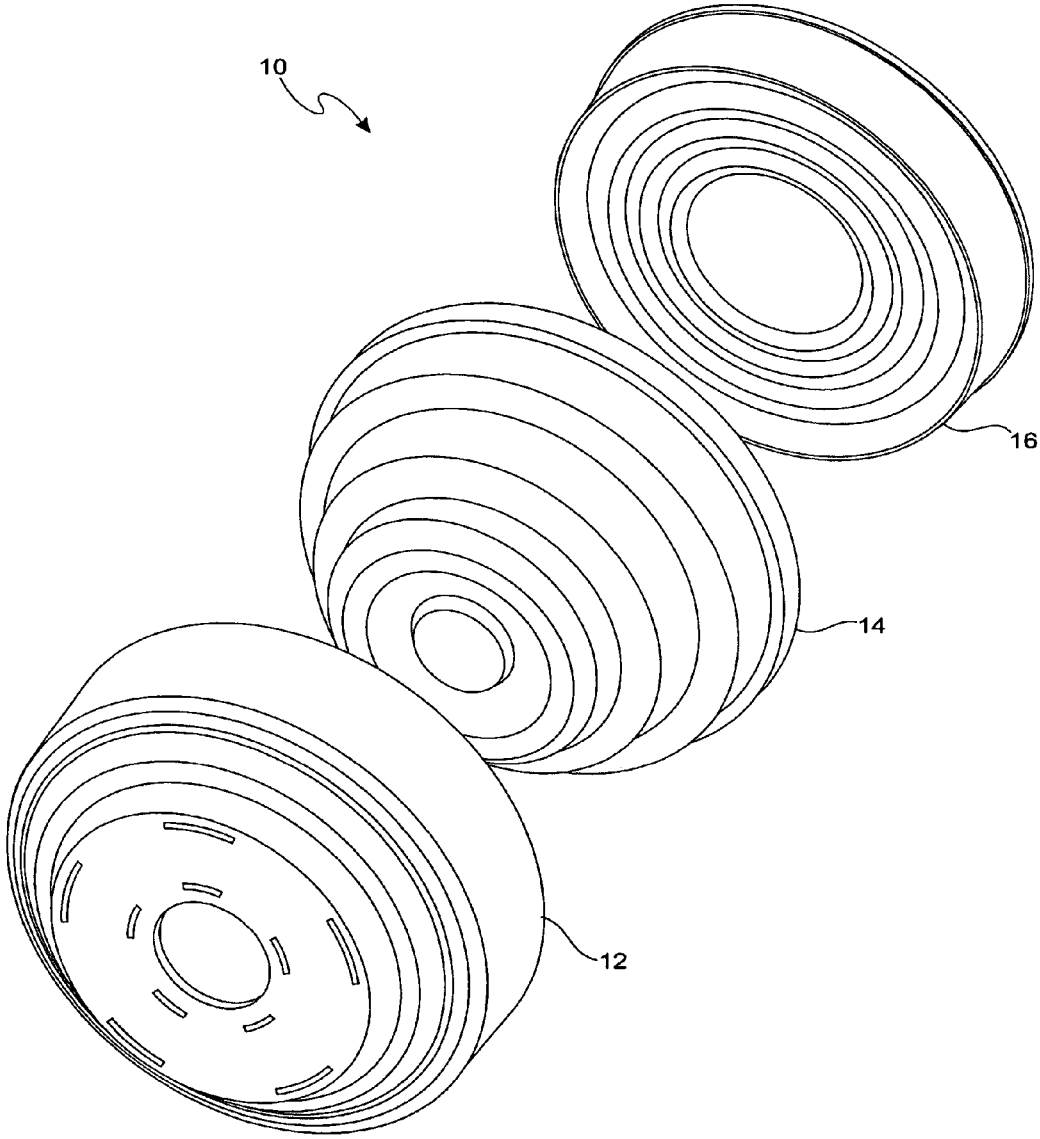
FIG. 2 is an exploded perspective bottom view of the self-heating tray.
Figure 3:
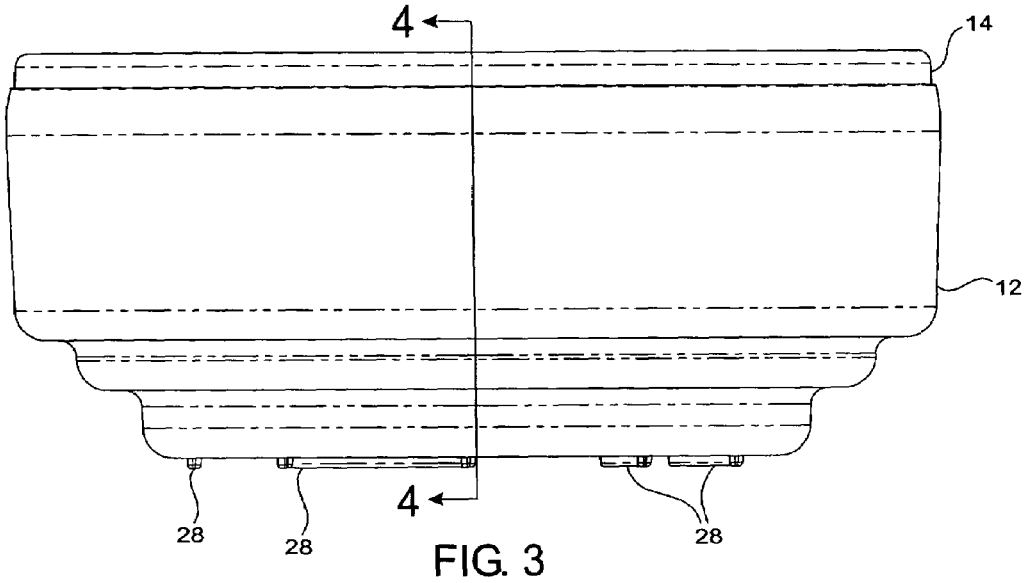
FIG. 3 is a side view of the self-heating tray.
Figure 4:
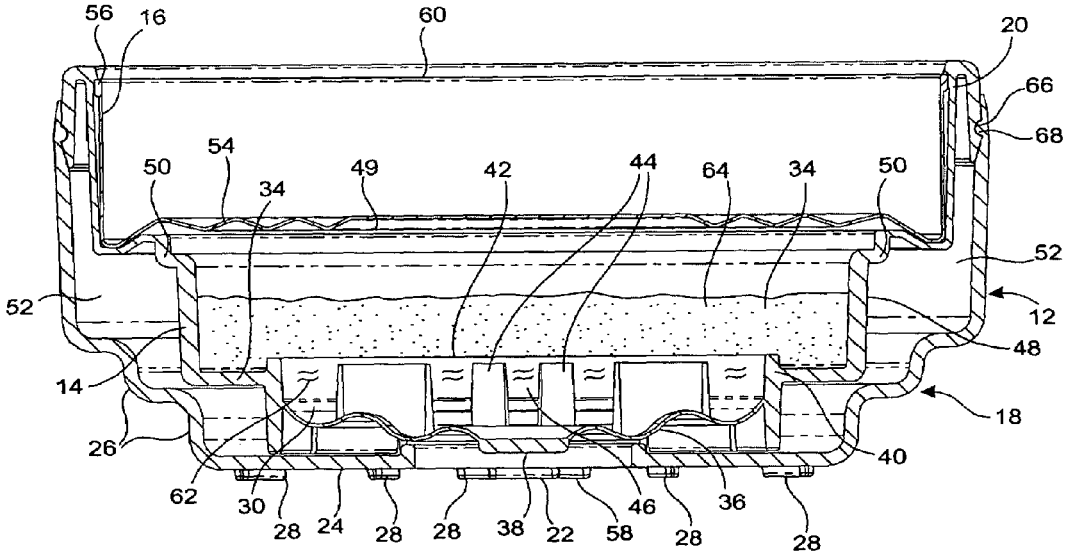
FIG. 4 is a cross-sectional view taken along line 4—4 of FIG. 3.
Figure 5:
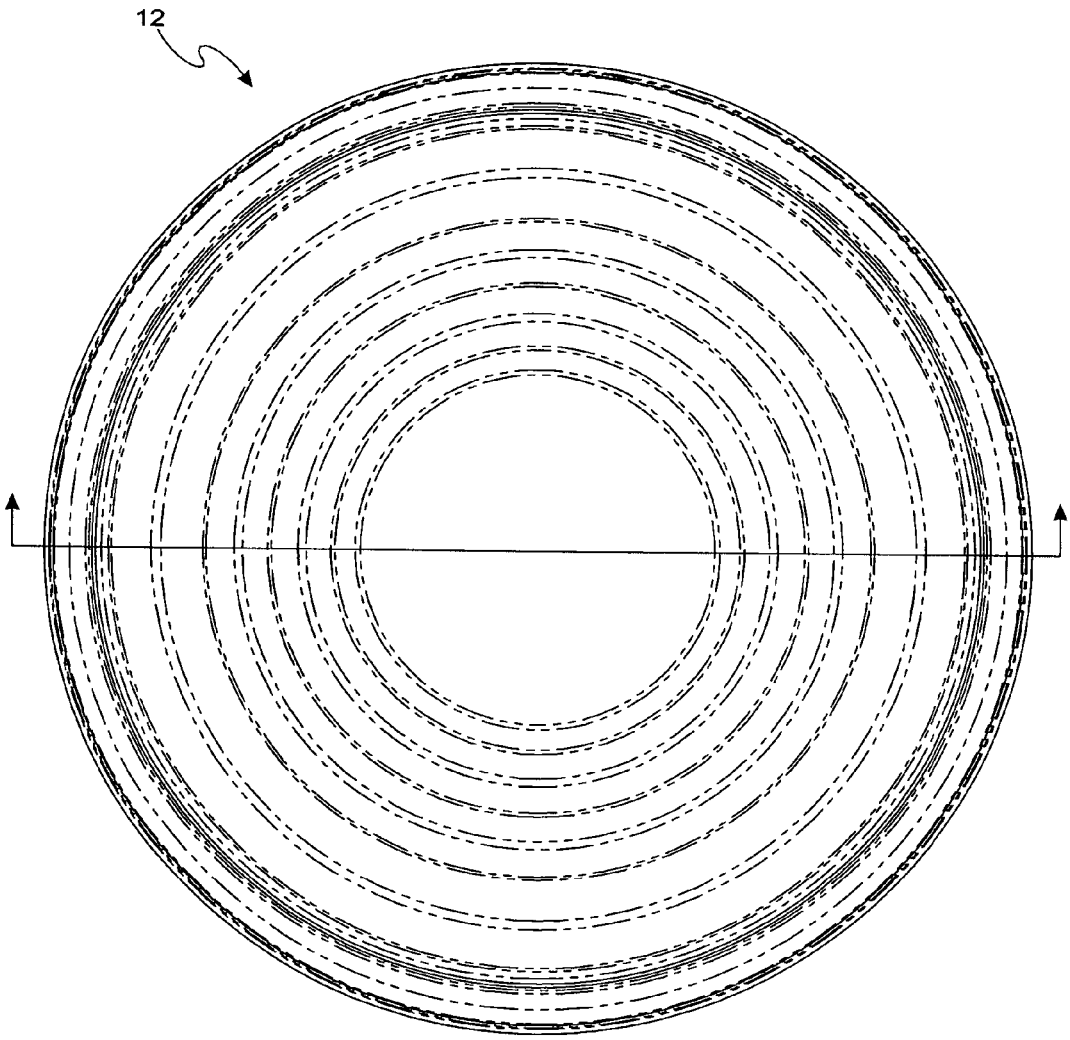
FIG. 5 is a top view of the self-heating tray.

The first compartment 18 has a relatively flat bottom surface 24 upon which the tray 10 can stably rest on a flat surface. The outer surface of the bottom surface may have a plurality of feet 28 for supporting the tray 10. The side walls 26 of the first compartment 18 extend upwardly from the bottom surface 24. The side walls 26 may extend upwardly and radially outward in a stepped configuration as best shown in FIGS. 1–2 and 4. The first compartment 18 houses the thermic module 14 which is disposed in the first compartment 18. The bottom surface 24 has a hole 22 through which an actuator button 38 of the thermic module 14 is accessible.

The second compartment 20 holds the food container 16 to be heated. The food container 16 may be held in the second compartment 20 by a snap-fit, by an adhesive or any other suitable means. The second compartment 20 may be formed in several different was: (i) separately from the first compartment 18; (ii) integral to the first compartment 18; (iii) as part of the thermic module; (iv) or as part of the first compartment 18 and part of the thermic module 14. FIGS. 1–5 show the second compartment 20 being formed by the upper extension of the first compartment 20 and the upper part of the thermic module 14.

Alternative to holding the food container 16, the second compartment 20 may directly contain the food products without the use of the food container 16. In such a configuration, the food products within the second compartment 20 would be sealed in the compartment by a removable lid placed over the top of the second compartment. The removable lid could be a full-panel pull off, a foil lid adhesively attached to the top surface of the second compartment, a lid removable by a standard can-opener or other suitable lid.

The food container 16 may have one or more partitions to create two or more food compartments. In this way, the thermic module 14 can be configured to heat each food compartment at different heat levels, including little or no heat at all to one or more of the compartments.

Figure 8:
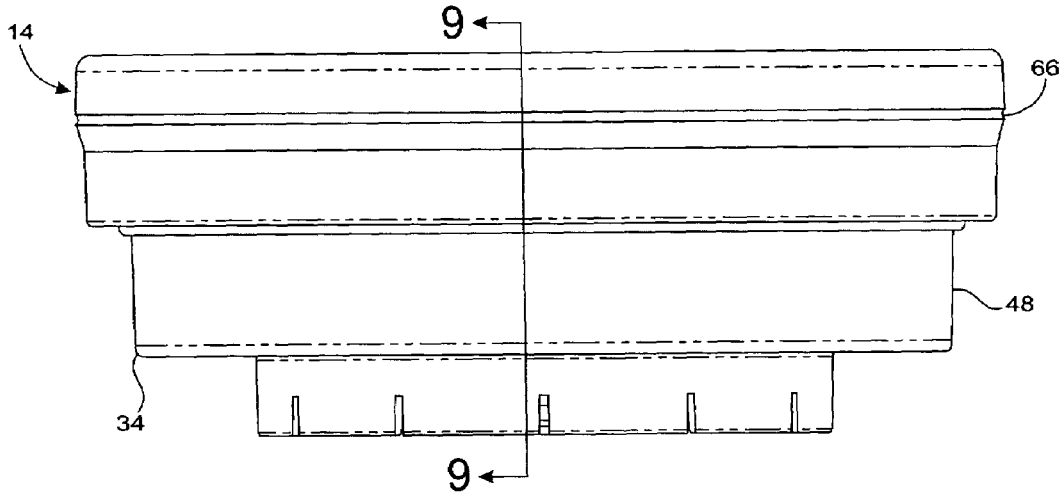
FIG. 8 is a side view of the thermic module of the self-heating tray of FIG. 1.
Figure 9:
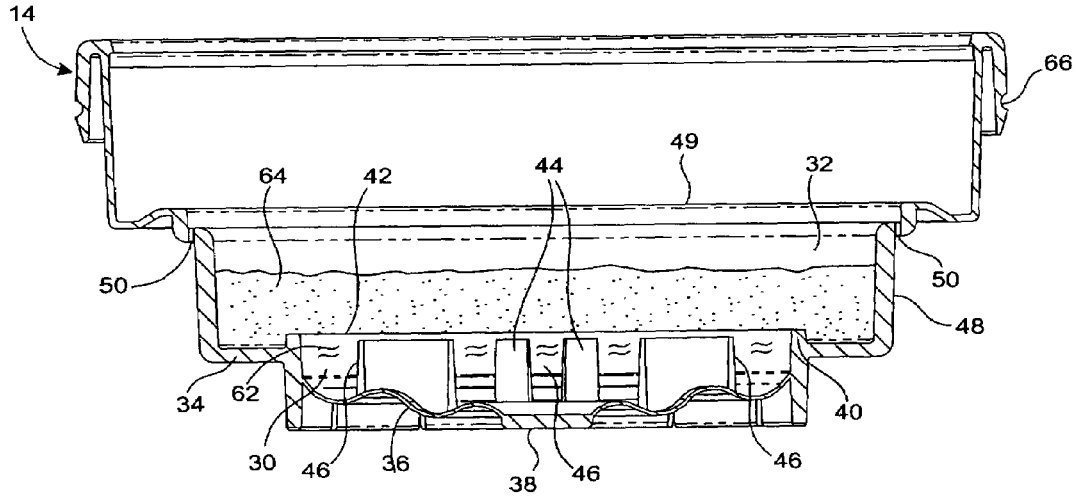
FIG. 9 is a cross-sectional view taken along line 9—9 of FIG. 8.

The thermic module 14 has two reactant chambers. The thermic module 14 is shown separately from the assembly 10 in FIGS. 8 and 9. The first reactant chamber 30 contains a first reactant (not shown) that is physically separated from a second reactant (not shown) contained in a second reactant chamber 32. The thermic module 14 comprises a dome-shaped body 34. The actuator button 38 is disposed at the bottom outer surface of the body 34. The walls of the body 34 extend radially outward from the actuator button 38 in a wavy surface 36. The wavy surface 36 makes the bottom of the body 34 relatively flexible so that the actuator button 38 can be pushed inwardly to actuate the thermic module 14. The actuator button 38 is accessible through the hole 22. A tamper-evident seal 58 is attached to the bottom surface 24 and covers the hole 22 such that the seal 58 must be removed or damaged to actuate the button 38. The tamper-evident seal 58 may be a foil decal adhesively attached to the bottom surface 24.

First reactant chamber walls 40 extend upwardly from the outer edge of the wavy surface 36 to form the upper boundary of the first reactant chamber. Outer walls 48 extend upwardly and radially in a stepped configuration from the first reactant chamber walls 40 to form the side perimeter of the second reactant chamber 32. The outer walls 48 may extend just to the bottom surface of the food container 16 or they may extend further up the side of the food container to provide heating on the sides of the food container 16 in addition to the bottom of the food container 16.

A plurality of cylindrical prongs 44 with elongated notches 46 are provided on the interior surface of the body 34 in the area of the wavy surface 36. A breakable reactant barrier 42 is provided at the top of the first reactant chamber walls 40 to separate the first reactant chamber 30 from the second reactant chamber 32. In general, one of the reactants is a liquid, such as water, and the other reactant is in a solid powdered or granular form, such as calcium oxide. The reactant barrier 42 may be made of foil and may be attached using adhesive or other suitable means. While the reactant barrier 42 may be adhesively attached to just the top annular surface of the first reactant chamber walls 40, it is preferable that the reactant barrier 42 extend over edge and down the side of the outside surface of the walls 40. Attaching the barrier 42 to the outside surface of the walls 40 creates a much stronger adhesive seal by increasing the shear strength of the bond.

A top surface 49 is provided at the top of the outer walls 48 to seal the second reactant chamber. The top surface 49 may be made of foil and may be attached to the outer walls 48 by adhesive or other suitable method. One or more vent holes 50 may be provided in the wall of either the first or second reactant chambers to provide a path through which gas can escape during the reaction to relieve the pressure within the first and second reactant chambers 30 and 32. The gas flows through the vent holes 50 and into an air space 52 between the body 34 of the thermic module 14 and the container body 12. This hot gas helps heat the sides of the second compartment 20 which in turn helps heat the food container 16. The large surface area of the container body 12 which is in contact with the cooler ambient air cools the steam thereby reducing the gas pressure.

The thermic module 14 may have a ring-shaped detent 66 for receiving a lip 68 of the container body 12 for retaining the thermic module in the container body 12. The thermic module 14 simply snaps into the container body 12 and the interference between the detent 66 and the lip 68 holds the thermic module in place. Alternatively, the thermic module 14 can be attached to the container body 12 by an adhesive, by ultrasonic or spin welding or by any other suitable method.

The food container 16 has a bottom surface 54 and a top surface 56. The food container 16 is shown separately from the assembly 10 in FIGS. 10 and 11. The bottom surface 16 is pressed against the top surface 49 in order to make a good thermal connection between the second reactant chamber 32 and the food container 16. The top surface of the food container 16 has a removable closure 60. The removable closure 60 is preferably removable as a full panel pull-off or by using a standard can opener. A full panel pull-off typically comprises a closure with a weakened region in the shape of the desired opening along which a pull-off lid breaks away from the remainder of the top surface 56. Alternatively, the closure a pop tab closure (e.g. the closure on a soft-drink aluminum can) or other removable lid which can be removed to access the food product contained in the food container 16.

The preparation of the self-heating tray 10 can be done in several ways. The food container 16 can be snapped or attached into the second compartment 20 after the tray 10 has gone through a retort process. Alternatively, an unfilled food container 16 can be placed into the second compartment 20 and the assembly can be sterilized in a retort process. Then the food container 16 can be filled and sealed. In still another process, the filled food container 16 can be installed in the tray 10 and then the entire assembly can be subjected to a retort process.

The use of the self-heating tray 10 is as follows. First, the user removes the tamper-evident seal 58 to expose the actuator button 38. The user depresses the actuator button 38 by pushing it inward. As noted above, the actuator button 38 is coupled to the flexible wavy surface 36 so that the wavy surface 36 resiliently deflects to allow the button 38 to move inwardly. The force exerted upon outer actuator button 38 urges the prongs 44 into the reactant barrier 42. The prongs 44 puncture the reactant barrier 42 which allows the first reactant in the first reactant chamber 30 to mix with the second reactant in the second reactant chamber 32. In general, the first reactant is a liquid which flows through the punctured reactant barrier 42 into the second reaction chamber 32 containing a solid reactant. The notches 46 in the prongs 44 facilitate the flow of the liquid reactant into the second reaction chamber 32. The resulting exothermic reaction produces heat, which is transferred to the food container 16 by conduction through the top surface 49 to the food container 16. As noted above, in other embodiments of the invention, other reactants may be selected that give rise to an endothermic reaction when mixed.

Gas or steam produced in the reaction escapes the reaction chambers 30 and 32 through vent holes 50. The hot gas or steam flows through the vent holes 50 and into an air space 52 between the body 34 of the thermic module 14 and the container body 12. This hot gas helps heat the sides of the second compartment 20 which in turn helps heat the food container 16. The large surface area of the container body 12 which is in contact with the cooler ambient air cools the steam thereby reducing the gas pressure.

The user can then invert the tray 10 and wait until the reaction heats the food in the food container 16, which typically occurs within about seven to ten minutes in a tray having a capacity of four to sixteen ounces of food. When the food is heated to the temperature at which it is to be consumed, the user removes the closure 60 giving access to the food contained within the food container 16. The heated food may be consumed directly out of the food container 16 or it may be removed and placed into or onto a plate or dish).

One of the reactants 62 or 64 may comprise specially designed calcium oxide particles. There are several characteristics of calcium oxide particles which will effect their reaction with the water. For example, varying the characteristics of the calcium oxide particles can affect such reaction attributes as volatility, rate of the reaction, and total amount of energy obtained from the reaction. Based on these characteristics, specific calcium oxide particles can be designed and produced to attain the desired overall reaction properties.

The porosity of the calcium oxide particles can greatly effect how volatile a particle will react when water is added. The processing of calcium oxide involves cooking it at 1000 degrees Fahrenheit which drives off moisture and gases that are naturally found in the material. This release creates pores in the material. The cooking time can be increased to a point where the pores will start to close back up in a process call a hard burn. By subjecting the particles to a proper amount of hard burn, the volatility of the reaction with water can be reduced to a more desirable level.

The size of the calcium oxide particles has an effect on how reactive that particle is. A group of small particles has more surface area that one large particle of equal weight. The greater the surface area, the faster and more thorough the particle will react when mixed with water. FIGS. 6–9 show transient temperature curves for particles of various sieve sizes ranging from a ¼ inch mesh (largest particle) through sieve #30 (smallest particle). In general, the curves show that smaller particles will heat up faster and also attain a higher maximum temperature. Accordingly, particles of various sizes may be chosen to produce the desired heating profile for the specific application for the container 100. For an application such as heating solid or semi-solid foods, a preferred distribution of particles sizes is:

| Particle Size (mesh) | Amount (%) |
|---|---|
| #7 | 2% maximum |
| #14 | 80% +/− 5% |
| #20 | 15% +/− 5% |
| Finer than #20 | 3% maximum |

Figure 10:
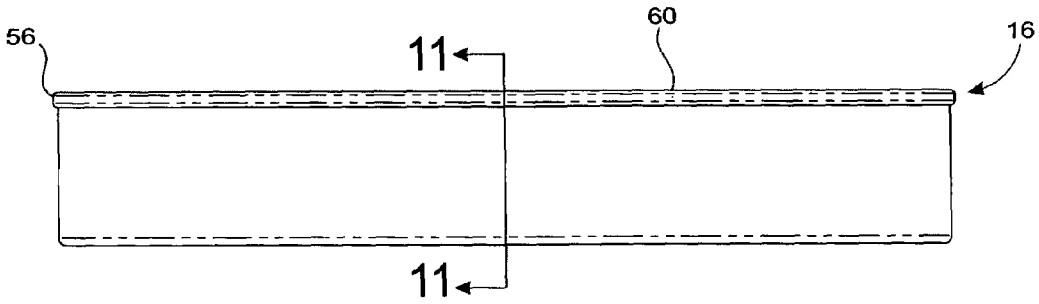
FIG. 10 is a side view of the food container of the self-heating tray of FIG. 1.
Figure 11:
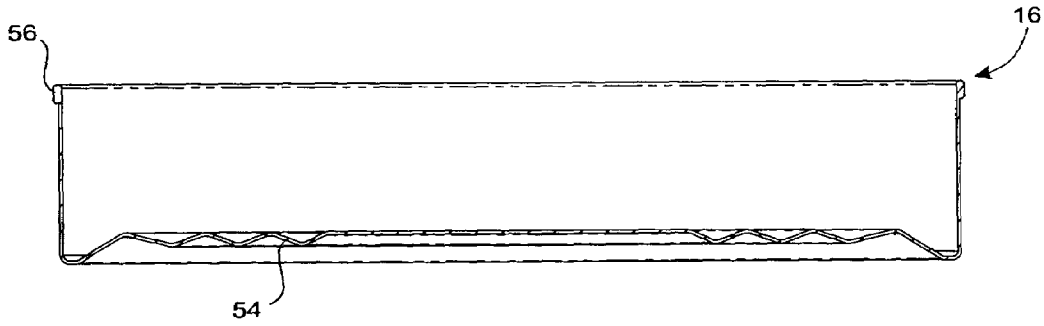
FIG. 11 is a cross-sectional view taken along line 11—11 of FIG. 10.

Additives can also be added to the calcium oxide to increase or decrease the reaction rate. The additives work by several different methods, including chemically, mechanically, or physically altering the interface of the calcium oxide with the water. One of the most important characteristics effecting the reaction is the reaction ratio, i.e. the ration of the calcium oxide to water. Different reaction/temperature curves can be obtained by varying the ratio of calcium oxide to water. For example, it is possible to maximize the peak energy produced by any one size of particle or porosity of a particle. The ratio can also be altered to slightly increase or decrease the overall rate of the reaction. The graphs of FIGS. 10–11 show the reaction/temperature curves for various ratios of water to calcium oxide. It can be seen that increasing the amount of water to 1.15 parts per 4 parts calcium oxide by mass (i.e. +15% H2O in FIG. 20), the fastest reaction is obtained and also the most energy of the ratios tested.

Figure 12:
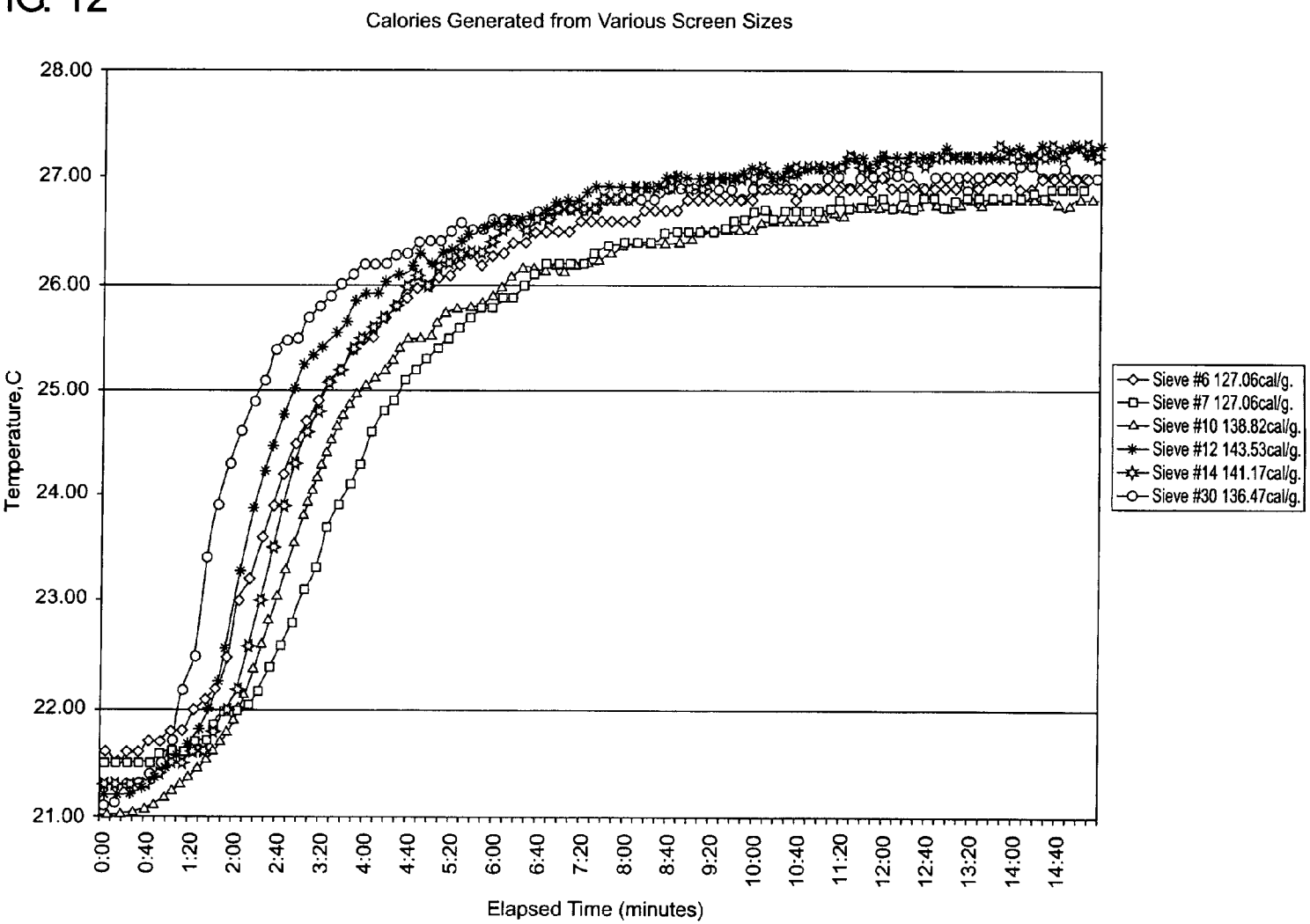
FIG. 12 is a graph of transient temperature curves for calcium oxide particles of various sieve sizes.

The water comprising the other reactant 132 or 138 may also be modified to optimize its use in the present invention. For example, the water quality is a critical component. Any chlorine in the water may cause the breakable barrier 130 to corrode and fail. Minute deviations in water quality can adversely affect the thermal reaction with the calcium oxide. Trace mineral components in the water should not exceed the concentrations shown on the table in FIG. 12.

Figure 13:
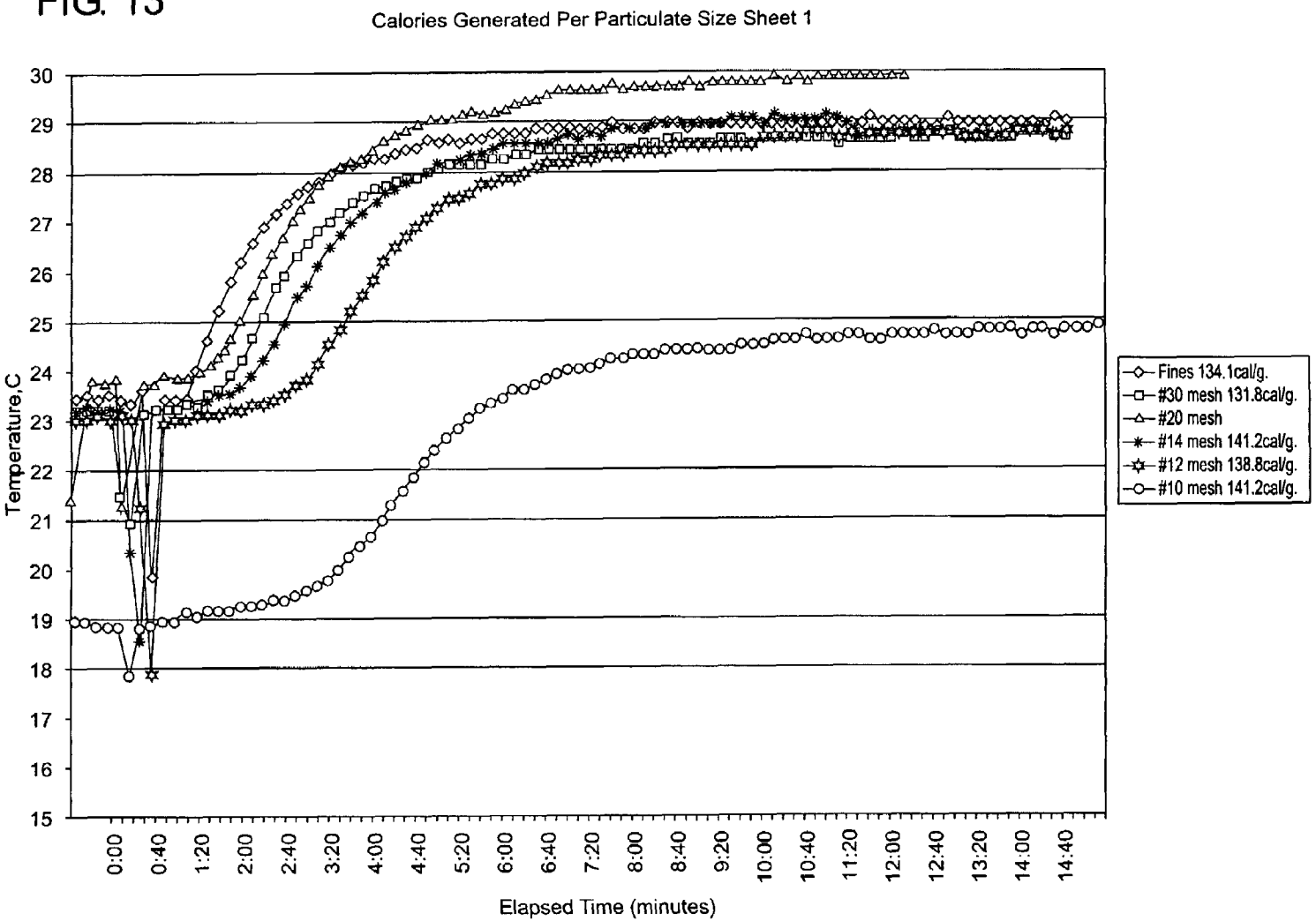
FIG. 13 is a graph of transient temperature curves for calcium oxide particles of various sieve sizes.
Figure 14:
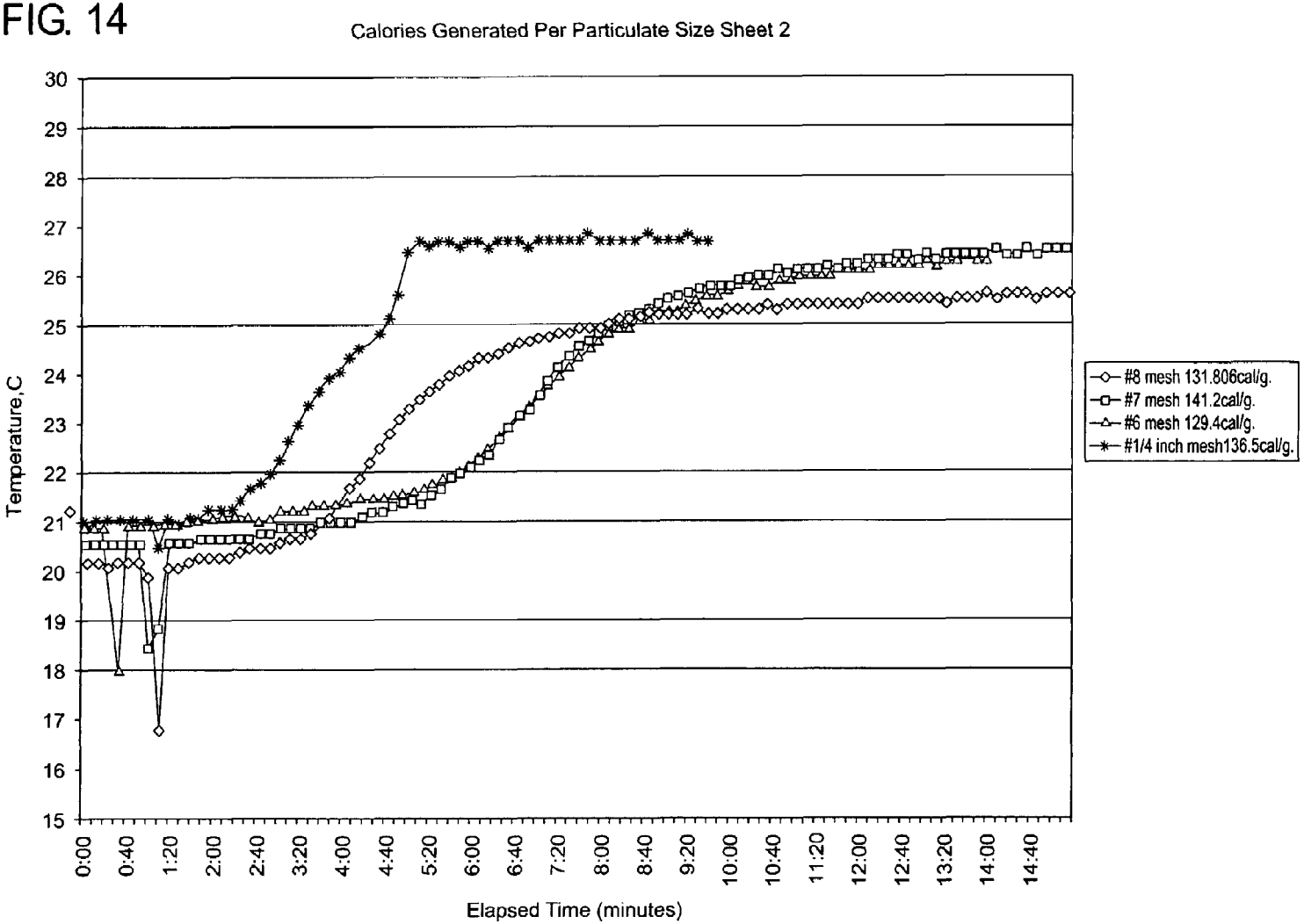
FIG. 14 is a graph of transient temperature curves for calcium oxide particles of various sieve sizes.
Figure 15:
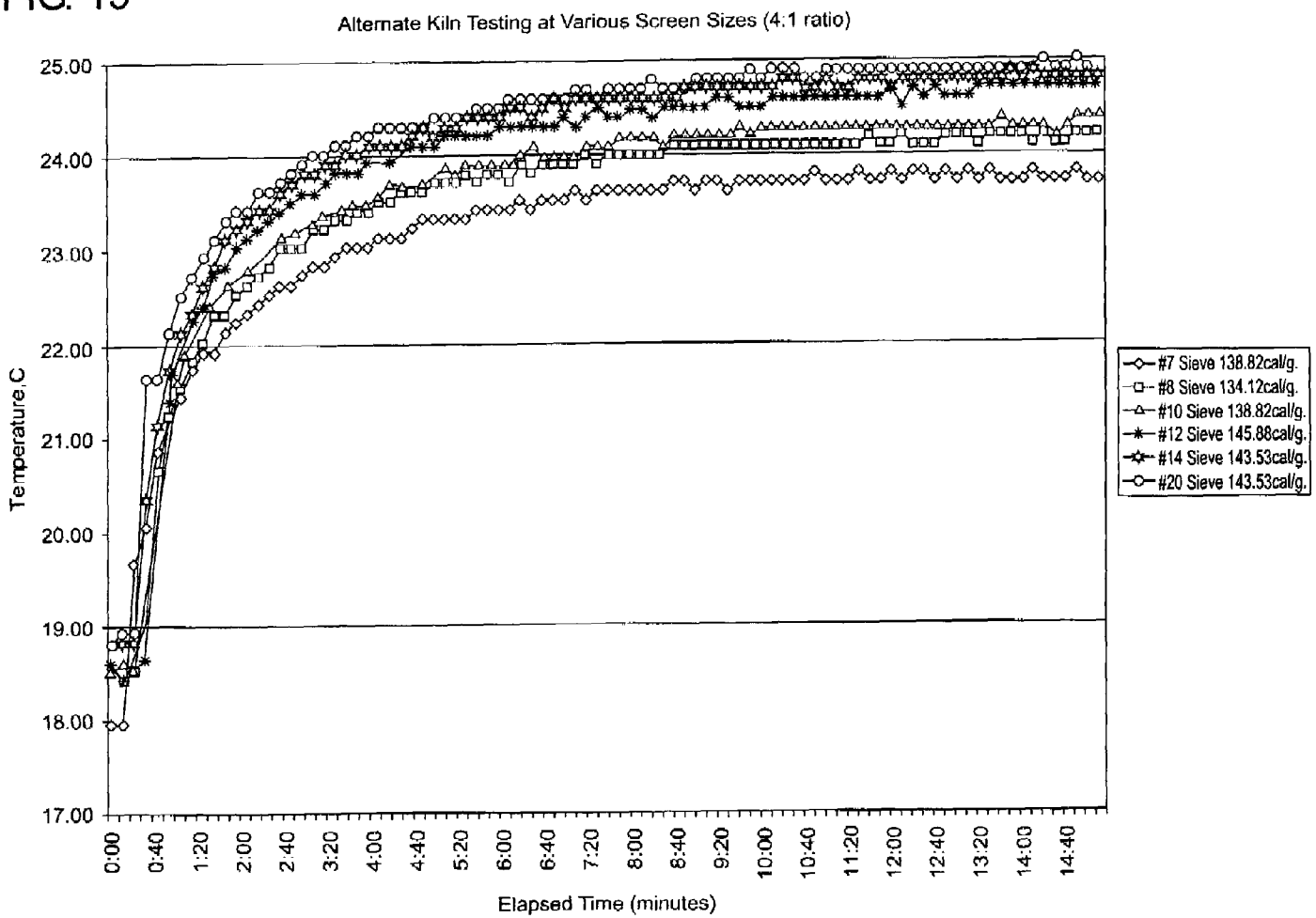
FIG. 15 is a graph of transient temperature curves for calcium oxide particles of various sieve sizes.
Figure 16:
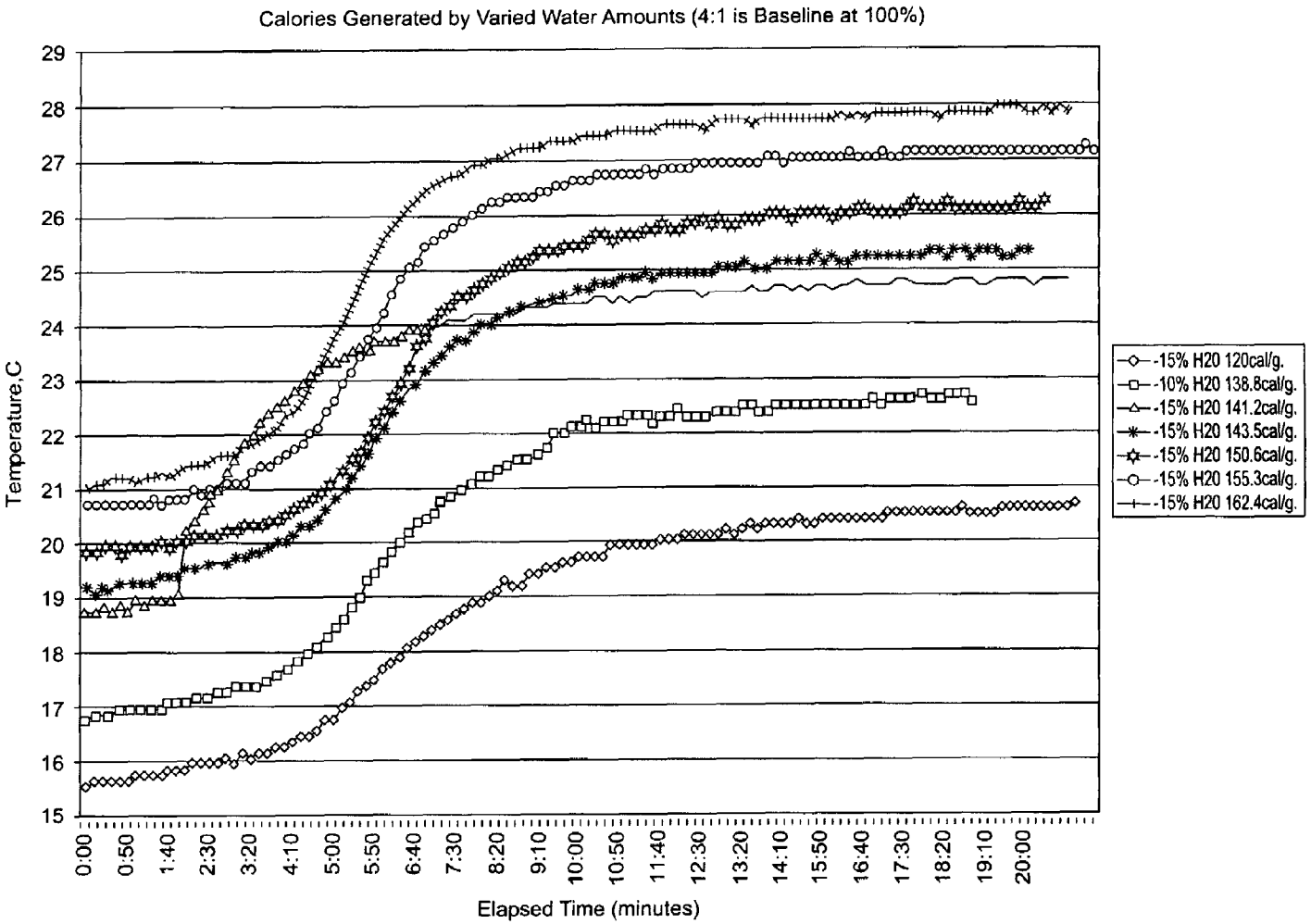
FIG. 16 is a graph of reaction/temperature curves for various ratios of water to calcium oxide.
Figure 17:
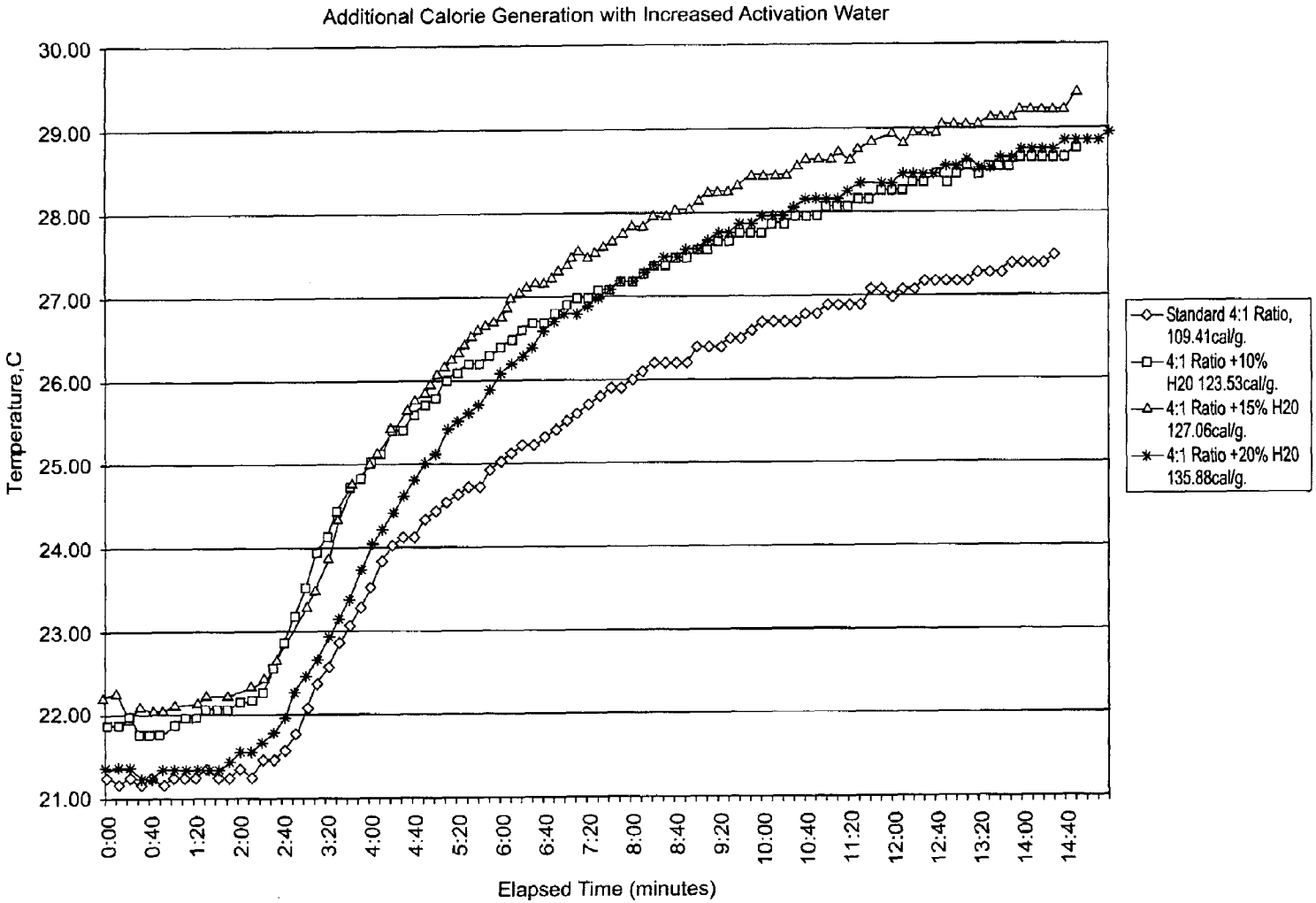
FIG. 17 is a graph of reaction/temperature curves for various ratios of water to calcium oxide.

Additives may also be added to the water to modify the reaction and improve the compatibility of the water with the other materials of the container. A list of possible additives and their properties is included in the table of FIG. 13.

What is claimed is:

1. A tray for selectably changing the temperature of its contents by mixing a first reactant with a second reactant, comprising:

a container body having a material chamber for containing said contents, said container body having a height and a width wherein said width is greater than said height, said container body having a bottom portion forming a first compartment and a top portion forming a second compartment for containing said contents; and a thermic module disposed in said first compartment, said thermic module comprising an actuator, a piercing member movable between a retracted position and an extended position in response to a force placed on a portion of said actuator, a first reactant chamber containing said first reactant and a second reactant chamber containing said second reactant, a breakable barrier attached to said first reactant chamber which seals said first reactant chamber from said second reactant chamber, wherein a distal end of said piercing member breaks said breakable barrier when said piercing member is in said extended position to allow mixing of said first and second reactants.

2. The tray of claim 1 wherein said breakable barrier is adhesively attached to a surface of said first reactant chamber.

3. The tray of claim 1 wherein said breakable barrier is attached to a surface of said first reactant chamber and also to the outside walls extending from said surface.

4. The tray of claim 1 wherein said actuator comprises a wavy surface forming a bottom portion of said first reactant chamber and said actuator further comprises an actuator button which is accessible through a hole in a bottom surface of said container body.

5. The tray of claim 1 wherein said tray is for heating one of solid, semi-solid or viscous food products.

6. The tray of claim 1 further comprising water contained in said first reactant chamber and calcium oxide contained within said second reactant chamber.

7. The tray of claim 1 further comprising at least one vent hole which vents gas produced by the mixing of said first and second reactants from inside said first and second reactant chambers to outside said first and second reactant chambers.

8. The tray of claim 7 wherein said at least one vent hole vents the gas to the interior of said container body surrounding said second compartment.

9. The tray of claim 8 wherein said first compartment at least partially surrounds said second compartment and there is an air gap between said first and second compartments in the area where said first compartment surrounds said second compartment.

10. The tray of claim 1 wherein said second compartment is configured to receive a separate container holding said contents by inserting said container into a cavity formed by said second compartment.

11. The tray of claim 10 wherein said container is held in said second compartment by a snap-fit in said cavity.

12. The tray of claim 1 wherein said the contents contained in said second compartment is accessed by opening a removable foil cover from the top of said second compartment.

13. The tray of claim 10 wherein said the contents contained in said container is accessed by opening a removable foil cover from the top of said container.

14. The tray of claim 1 wherein said the contents contained in said second compartment is accessed by opening a full panel pull-off from the top of said second compartment.

15. The tray of claim 10 wherein said the contents contained in said container is accessed by opening a pull panel pull-off from the top of said container.

16. The tray of claim 1 wherein said second compartment comprises at least one partition to create at least two contents compartments and said thermic module is configured to heat each contents compartment at different heat levels.

17. The tray of claim 16 wherein at least one of said different heat levels is substantially no heat.

18. The tray of claim 1 further comprising an air space surrounding said second compartment and a flow path between said air space and one of said first or second reactant chambers such that gas formed by the mixing of said first and second reactants can flow into said air space thereby heating said contents.

19. The tray of claim 18 wherein said air space is bounded on the exterior of said air space by said container body and wherein contact with said container body cools the gas thereby reducing the gas pressure.

* * * * *